United States Patent [19]

Gould et al.

[11] 4,431,462

[45] Feb. 14, 1984

[54] METHOD OF MAKING MULTI-BONDED SILVER-CADMIUM OXIDE MATERIAL

[75] Inventors: Lawrence J. Gould, Wellesley; Yuan-Shou Shen, Reading, both of Mass.

[73] Assignee: Engelhard Corporation, Iselin, N.J.

[21] Appl. No.: 386,124

[22] Filed: Jun. 7, 1982

[51] Int. Cl.[3] ..... C22F 1/14

[52] U.S. Cl. ..... 148/11.5 Q; 148/431; 148/11.5 R; 228/179; 228/235; 428/673

[58] Field of Search ..... 428/673, 637; 148/11.5 R, 11.5 P, 11.5 Q, 431; 29/878, 879; 228/178, 179, 190, 235, 243

[56] References Cited

U.S. PATENT DOCUMENTS 3,807,994 4/1974 Jost ..... 428/673

FOREIGN PATENT DOCUMENTS 697916 11/1964 Canada ..... 148/11.5 Q 2725328 7/1978 Fed. Rep. of Germany .

*Primary Examiner*—L. Dewayne Rutledge

*Assistant Examiner*—Christopher W. Brody

[57] ABSTRACT

A silver-cadmium oxide material having throughout a substantially uniform cadmium oxide distribution and suitable for use as electrical contact material is made from silver-cadmium oxide having an internal cadmium oxide depleted zone. The layers are bonded together by hot rolling which reduces the bonded material to a thickness less than the original thickness of the combined layers. Two or more layers of material are superimposed one over another and bonded and reduced in thickness by hot rolling. The process is repeated with bonded material from preceding steps a sufficient number of times to obtain a material having a substantially uniform dispersion of cadmium-oxide particles throughout the interior thereof.

14 Claims, No Drawings

METHOD OF MAKING MULTI-BONDED SILVER-CADMIUM OXIDE MATERIAL

BACKGROUND OF THE INVENTION

The present invention relates to an improved silver-cadmium oxide material of the type suited for use as electrical contact material, and to a method of making the same.

Silver-cadmium oxide strips for electrical contact material are well known in the art and are conventionally made by heating a silver-cadmium alloy to an elevated temperature in an oxidizing atmosphere to "internally oxidize" the cadmium. Typically, an alloy of 5 to 30 weight percent cadmium with silver is utilized. Minor amounts of grain refining ingredients may also be in the alloy, as is known in the art. By heating the alloy, say at a temperature of 750° C. for a period of six hours, the cadmium is oxidized to cadmium oxide and a material which contains cadmium oxide particles dispersed in the body of silver is obtained.

One difficulty is that during the oxidation of the cadmium to cadmium oxide, the cadmium oxide tends to migrate from the interior of the silver-cadmium strip or bar being oxidized towards the surfaces thereof, resulting in a cadmium oxide depleted zone in the interior of the material. Thus, the oxidized strip or bar has an interior "depleted" zone, i.e., an interior core which is silver-rich but poor in cadmium oxide. The area of the material adjacent the outer surfaces thereof is correspondingly rich in cadmium oxide. The occurrence of such depleted zones is disadvantageous inasmuch as when the material is placed in use, such as use as an electrical contact, mechanical and electrical arcing wear on the surfaces wears away the cadmium oxide-rich area and exposes an area depleted or at least significantly poorer in cadmium oxide.

The prior art has attempted to overcome the problem of the cadmium oxide depleted zone forming during oxidation of the silver-cadmium material by utilizing a powder metallurgy technique in which silver and cadmium powders are blended, pressed and sintered to form the silver-cadmium oxide material which is extruded into finished form. In another technique, cadmium oxide powder is blended with the silver powder and similiarly treated. In this case, pre-oxidizing of the cadmium avoids the migration of cadmium oxide which takes place during oxidation of the conventional silver-cadmium alloy. However, materials made by these powder metallurgy techniques have been found to have inferior integrity in use as electrical contact materials.

Another type of technique employed by the prior art in order to overcome the problem of formation of cadmium oxide depleted zones in the material, is to oxidize very thin strips or sheets of silver-cadmium material to form the cadmium oxide. Because of the thinness of the sheets, the relative size of the resultant depleted zone is smaller. A number of such oxidized thin sheets, usually twenty to thirty, are then bonded together by rolling to form a strip of material which has alternate layers or strata of cadmium oxide particle-rich areas (formerly surface and near-surface areas) interspersed with very thin depleted zone areas. However, silver-cadmium oxide contact material made in this manner has a non-uniform cadmium oxide particle distribution because of the above mentioned alternating layers of cadmium oxide rich and cadmium oxide depleted areas, as well as showing non-uniform cadmium oxide particle size distribution.

The problem of internal cadmium oxide depleted zones is recognized in the art, for example, see U.S. Pat. No. 3,545,067 (Haarbye et al). This patent discloses forming the bimetal electrical contact material by forming a silver-cadmium shot, internally oxidizing the shot and compacting the extruding the shot. The patent also discloses the known technique of hot roll bonding a fine silver backing sheet to the extruded strip.

U.S. Pat. No. 3,807,994 (E. M. Jost) discloses a method for making silver-cadmium oxide contact material in which the cadmium oxide depleted zone can be effectively eliminated, and discloses that this is attained by pressure bonding a layer of silver-cadmium alloy of selected, relatively high cadmium content between layers of silver-cadmium alloy of relatively lower cadmium content, so as to form a composite silver-cadmium alloy material. This composite material is, after assembly, heated in an oxygen containing atmosphere to internally oxidize the cadmium content of the composite material.

It is an object of the present invention to provide a novel process for producing a silver-cadmium oxide material and a novel product of such process, one in which the cadmium oxide depletion has been substantially eliminated and the product has excellent metallurgical integrity characteristic of a wrought product.

SUMMARY OF THE INVENTION

In accordance with the present invention there is provided a method of manufacturing a silver-cadmium oxide product which comprises the following steps. (a) At least two layers of a silver-cadmium oxide strip material which has an internal cadmium oxide-depleted zone are superimposed, one over another. (b) The superimposed layers are bonded by hot rolling them under pressure to reduce the thickness of the combined layers and form a bonded material. (c) At least two layers of the bonded material are superimposed one over another. (d) The superimposed layers of bonded material from step (c) are bonded by hot rolling them under pressure to reduce the thickness of the combined layered and form a bonded material. (e) Steps (c) and (d) are repeated with the resultant layers of bonded material for a number of times are required to obtain the product having throughout a substantially uniform distribution of cadmium oxide.

In accordance with one aspect of the invention, steps (c) and (d) are repeated a sufficient number of times to obtain a strip of product material made from at least 1,000 bonded layers, preferably about 1,000 to about 2,200 bonded layers, more preferably at least 1,024 or at least 2,187 layers, by stacking and bonding the same material obtained from the previous steps.

In one aspect of the invention, there is carried out a preliminary additional step of oxidizing a silver-cadmium alloy to produce the silver-cadmium oxide strip material which has an internal cadmium oxide-depleted zone.

In a preferred aspect of the invention, the layers of silver-cadmium oxide material having an internal cadmium oxide depleted zone have a thickness of from about 0.38 centimeter (cm) to 0.64 cm, preferably 0.38 cm to 0.153 cm, the hot rolling is carried out at a temperature of from about 648° C. to 872° C., and the thickness of the bonded layers is reduced by the hot rolling to about four-fifths to one-half of the pre-rolling thickness of the combined layers.

In one aspect, the invention provides for a silver-cadmium oxide product having throughout a substantially uniform distribution of cadmium oxide, and made by a method as described above.

DESCRIPTION OF THE PREFERRED EMBODIMENTS

A typical starting material for the product and process of the present invention comprises cast silver-cadmium alloy bars. Typically, such material destined for utilization as electrical contact material contain not more than that amount of cadmium which, upon oxidation of the material, will yield a product containing not more than about twenty percent by weight cadmium oxide (as cadmium oxide), preferably 5 to 15 percent by weight cadmium oxide, with the balance essentially comprising silver and only very small quantities of trace impurities or other ingredients such as grain refining agents. The material is conventionally heated in air at a temperature and for a time sufficient to oxidize the cadmium to cadmium oxide, e.g., at a temperature of from 700° C. to 925° C. for a period of about five to seven hours. Such treatment to oxidize the cadmium while leaving the silver unreacted is generally referred to as "internal oxidation".

The thus oxidized strip, which may have a thickness of up to, e.g., 0.65 cm, will have a cadmium oxide depleted zone which may amount to about 30 percent of its cross sectional area, the cadmium having migrated during the oxidation treatment step from the interior towards the external surfaces of the metal strip.

Thicker bars or strips of starting material could be employed, but for such thicker strips the amount of time necessary to oxidize substantially all the cadmium contained within the strip becomes excessive. On the other hand, there are practical and economic limits as to how thin the starting strip can be rolled prior to the oxidation and still be able to be convenient handled and utilized in fabricating the product. Accordingly, as a practical matter, strips of silver-cadmium alloy, or silver-cadmium oxide after the internal oxidation step, for use as the starting material of the invention, preferably have a thickness of not more than about 0.635 cm (about one-quarter of an inch) and not less than about 0.038 cm (about fifteen one-thousandths of an inch).

Two or more strips of silver-cadmium oxide material, preferably of substantially identical thickness and width and cut to the same length, are then superimposed or stacked one over the other and bonded together to provide a layer of bonded material. The bonding is attained in the known manner by hot rolling the superimposed layers by heating them to an elevated temperature, e.g., of about 648° C. to about 872° C., say about 750° C., and squeezing the thus-heated stacked layers while still at the elevated temperature between pressure rolls in a known type of rolling mill and under sufficient pressure to reduce the original unrolled thickness of the combined layers by as much as about one-half of the pre-rolling thickness. The strips will be permanently bonded together under such treatment. The resultant reduced thickness, bonded material may be then cut into two or more strips of equal length and the strips superimposed one above the other and the hot rolling then carried out again. The process may be repeated as many times as required to finally attain a bonded product have a substantially uniform dispersion of cadmium oxide particles throughout, that is, the cross section of the product material will show a substantially uniform dispersion of cadmium oxide particles throughout the cross section of the product.

If the process is carried out by stacking or superimposing two layers of material in each hot rolling bonding operation, and carrying out a total of ten such stacking and hot rolling steps, the result will be $2^{10}=1{,}024$ layers of material rolled into each other. As a result, the increasingly fine strata of cadmium oxide rich surface areas and cadmium oxide depleted core areas are alternated in thinner and thinner strata until the strata, for all practical purposes, disappear in a substantially uniform dispersion of cadmium oxide particles. Obviously, any suitable number of strips may be stacked in the process of the invention, and it is not necessary that the same number of stacked strips be used for each hot rolling bonding step. However, it may be desirable for simplifying the manufacturing process to do so. For example, three layers may be stacked in each hot rolling step and the hot rolling steps repeated a total of seven times to provide a product in which $3^7=2{,}187$ layers of material have been rolled into each other.

As an alternative to cutting and stacking the strips, the elongated strip resulting from the hot rolling operation may simply be foled back on itself, or cutting and stacking and such folding steps may both be used during the process.

By the use of repeated superimposing of layers of material and repeated hot rolling bonding for a sufficient number of times to provide a bonded product resulting from the bonding of at least about a thousand layers, there results a material whose cadmium oxide particle distribution is substantially uniform throughout. That is, the cadmium oxide particles are uniformly distributed throughout the mass of the material, the cadmium oxide depleted zone of the starting material being substantially completely eliminated from the product material. Further, the resulting material has the workability of a wrought material. The present invention thus overcomes the deficiencies noted in prior art powder metallurgy and conventional hot rolling bonding techniques.

As indicated above, there is a practical limit to how thin an individual strip of silver-cadmium oxide may be made, so that the prior art technique of making strips thinner than those needed for the final product and bonding such thin strips together to form the final product is inherently limited to bonding together a much smaller number of layers, e.g., about 20 to 30 or so layers of individual material. Although each individual layer is thin, it is still thick enough to have a significant depleted zone problem and the resulting layer, as shown by 100×photomicrograph studies, shows a stratified configuration, with alternating cadmium-oxide rich and cadmium oxide-depleted strata. Photomicrographs (100×) of cross section cuts of silver-cadmium oxide strip material made in accordance with the present invention show, in contrast, a uniform dispersion of cadmium oxide particles with no discernible strata. Photomicrographs (100×) of cross section cuts of conventional internal oxidized silver-cadmium oxide strip show the usual cadmium oxide depleted zone in the cross sectional interior of the material.

The efficacy of the present invention is illustrated by the following examples.

Example I

A silver-cadmium alloy bar 0.038 cm (0.015 inch) thickness and uniform width is internally oxidized in the conventional manner by being heated for six hours in air at a temperature of 815.5° C. (1500° F.) to provide a silver-cadmium oxide bar displaying in cross section a cadmium oxide depleted zone extending longitudinally along the bar. The alloy contains sufficient cadmium to provide 15 weight percent cadmium oxide (measured as the oxide) in the bar upon oxidation of all the cadmium present. The depleted zone results from the known migration of cadmium (oxide) particles towards the outer surfaces of the bar during the oxidation heat treatment.

Two strips of identical thickness and length are cut from the bar, to provide two identically dimensioned bars of the internally oxidized silver-cadmium material. These two bars are stacked with one superimposed over the other and bonded together by hot rolling at a temperature of 815.5° C. (1500° F.) in a rolling mill in which the combined layers are rolled down to a thickness which is one-half of the pre-rolling thickness of the two stacked layers of strip material to bond the two layers together. The resultant bonded material is cut into two equal lengths to provide two equally dimensioned strips of bonded material which are similiarly stacked and hot-rolled bonded. The process is repeated until a total of ten hot rolling bonding steps have been carried out. The result is a 0.038 cm (0.015 inch) thick product material made from $2^{10}$ or 1,024 bonded layers of material. Micrographic examination of the cross-section of the resultant product material shows a uniform distribution of cadmium oxide particles throughout the cross section of the material and elimination therefrom of the depleted zone characteristic of the unrolled internally oxidized starting material. The resultant product material has excellent malleability and working characteristics of a wrought material. The silver-cadmium oxide product material comprises 15 percent by weight cadmium oxide, balance essentially silver with not more than trace quantities of other acceptable materials.

EXAMPLE II

The process of Example I is carried out in identical fashion, except that for each stacking step, three layers are superimposed one over the other and the hot rolling bonding steps are carried out for a total of seven times in order to provide a product material made from $3^7$ or 2,187 bonded layers.

The silver-cadmium oxide product material obtained in accordance with the invention is highly advantageous in applications in which such materials are employed, such as electrical contact materials. A silver backing may be applied to the silver-cadmium oxide material by known methods as is conventional, in order to facilitate brazing of the material to steel or other supports. Mechanical and/or electrical arcing wear on the silver-cadmium oxide material does not result in a change of the composition thereof, because of the uniform composition, i.e., the uniform distribution of cadmium oxide particles throughout the body of the silver-cadmium oxide material presents a working surface of uniform composition, despite wear of the material.

While the invention has been described in detail with respect to specific preferred embodiments, it will be apparent that changes and modifications thereto will occur to the skilled practitioner upon a reading and understanding of the foregoing. Generally, material of any suitable thickness may be employed in the invention and any combination of temperature and pressure of the hot rolling step sufficient to attain bonding and the required thickness reduction of the material may be utilized.

What is claimed is:

1. A method of manufacturing a silver-cadmium oxide product comprises:

(a) superimposing one over another at least two layers of a silver-cadmium oxide strip material which has an internal cadmium oxide-depleted zone;

(b) bonding the superimposed layers by hot rolling them under pressure to reduce the thickness of the combined layers and form a strip of bonded material;

(c) superimposing one over another at least two layers of the bonded material;

(d) bonding the superimposed layers of bonded material from step (c) by hot rolling them under pressure to reduce the thickness of the combined layers and form a bonded material;

(e) repeating steps (c) and (d) with the resultant layers of bonded material for a number of times as required to obtain said product having throughout a substantially uniform distribution of cadmium oxide.

2. The method of claim 1 wherein steps (c) and (d) are repeated a sufficient number of times to obtain a product material made from at least 1,000 bonded layers.

3. The method of claim 1 or claim 2 including a preliminary additional step of oxidizing a silver-cadmium alloy to produce said silver-cadmium oxide strip material.

4. The method of claim 1 wherein step (a) two layers are superimposed, one over another, and steps (c) and (d) are carried out a total of at least nine times to provide a product strip made from at least 1,024 bonded layers.

5. The method of claim 1 wherein in step (a) three layers are superimposed, one over another, and steps (c) and (d) are carried out a total of at least six times to provide a product strip made from at least 2,187 layers.

6. The method of claim 1 wherein said layers are of thickness of about 0.038 cm to 0.635 cm.

7. The method of claim 1 wherein steps (a) and (c) said layers are superimposed one over another by folding a single strip of said material back on itself.

8. The method of claim 1 wherein said layers of bonded material superimposed one over another in step (c) are obtained by cutting into strips of approximately equal size the strips of bonded material obtained in the bonding of steps (b) and (d).

9. The method of claim 1 wherein said bonding by hot rolling is carried out at a temperature of from about 648° C. to 872° C.

10. The method of claim 1 or claim 2 wherein the thickness of the combined layers is reduced by each of the respective hot rollings of steps (b) and (d) to about four-fifths to one-half of the pre-rolling thickness of the combined layers.

11. The method of claim 1 which comprises:

(a) superimposing one over another at least two layers of silver-cadmium oxide strip material which has an internal cadmium oxide-depleted zone;

(b) bonding the superimposed layers by hot rolling them at a temperature of from about 648° C. to 872° C. under pressure to reduce the thickness of the combined layers to about four-fifths to one-half of the pre-rolling thickness of the combined layers and form a strip of bonded material;

(c) superimposing one over another at least two layers of said bonded material;

(d) bonding the superimposed layers of bonded material by hot rolling them at a temperature of from about 648° C. to 872° C. under pressure to reduce the thickness of the combined layers to about four-fifths to one-half of the pre-rolling thickness of the combined layers and form a strip of bonded material;

(e) repeating steps (c) and (d) with the layers of bonded material for a number of times as required to obtain a product strip having throughout a substantially uniform distribution of cadmium oxide.

12. The method of claim 1 wherein steps (c) and (d) are repeated a sufficient number of times to obtain a product strip made from about 1,000 to 2,200 bonded layers.

13. The method of claim 11 or claim 12 including a preliminary additional step of oxidizing a silver-cadmium alloy to produce said silver-cadmium oxide material.

14. The method of claim 11 wherein said layers of step (a) are of a thickness of from about 0.038 to 0.635 cm.

* * * * *